US005275134A

United States Patent [19]

Springer

[11] Patent Number: 5,275,134

[45] Date of Patent: Jan. 4, 1994

[54] TWO STROKE INTERNAL COMBUSTION ENGINE HAVING AN INTAKE PISTON ADJACENT EACH POWER PISTON

[76] Inventor: Joseph E. Springer, 11247 Monte Vista, Ontario, Calif. 91762

[21] Appl. No.: 47,467

[22] Filed: Apr. 19, 1993

[51] Int. Cl.[5] ..... F02B 59/00

[52] U.S. Cl. ..... 123/42; 123/70 R

[58] Field of Search ..... 123/42, 70

[56] References Cited

U.S. PATENT DOCUMENTS

| | | | |
|---|---|---|---|
| 878,578 | 2/1908 | Thompson | 123/42 |
| 1,135,365 | 4/1915 | Dock | 123/42 |
| 1,374,140 | 4/1921 | Dock | 123/42 |
| 1,785,176 | 12/1930 | Berner et al. | 123/42 |
| 1,877,760 | 9/1932 | Berner et al. | 123/42 |
| 2,522,649 | 9/1950 | Tenny | 123/70R |
| 4,767,287 | 8/1988 | Marks | 123/42 |

*Primary Examiner*—Tony M. Argenbright
*Assistant Examiner*—M. Macy
*Attorney, Agent, or Firm*—Edgar W. Averill, Jr.

[57] ABSTRACT

A two stroke internal combustion engine having an intake piston which feeds air to an adjacent power piston. Both the intake piston and the power piston are held in oscillating cylinder assemblies and the piston rods are integral with the pistons so that the piston rod is always in line with the piston. The cylinder assemblies are both supported by trunnions and the air from the intake cylinder assembly is fed through an opening in the center of the two trunnions between the intake cylinder assembly and the power cylinder assembly. Preferably the rod portion of the intake piston and rod assembly is shorter than the rod portion of the power piston and rod assembly.

13 Claims, 7 Drawing Sheets

TWO STROKE INTERNAL COMBUSTION ENGINE HAVING AN INTAKE PISTON ADJACENT EACH POWER PISTON

BACKGROUND OF THE INVENTION

The field of the invention is internal combustion engines and the invention relates more particularly to two stroke internal combustion engines. It is long been recognized that power is lost in an internal combustion engine by the positioning of a connecting rod which travels through a series of angles with respect to the central axis of the piston. Several early attempts have been made to eliminate this inefficiency by providing a solid piston and rod assembly held within an oscillating cylinder wall. Such constructions are shown in U.S. Pat. Nos. 878,578; 1,135,365; 1,785,176; 1,877,760; 1,821,173; and 4,767,287.

Another problem associated with two stroke engines relates to the difficulty in forcing air into the cylinder during the intake stroke and removing exhaust gases during the exhaust stroke. The subject is discussed at some length in the September 1992 issue of *Popular Mechanics* beginning at page 33. Superchargers have been used to force air into the cylinder but superchargers have their own set of problems including weight and maintenance problems. Furthermore, the inherent inefficiency of the angled connecting rod adds inefficiency to the operation of the engine.

SUMMARY OF THE INVENTION

It is an object of the present invention to provide a two stroke internal combustion engine having an intake cylinder adjacent a power cylinder with both the intake piston and the power piston having an integral rod assembly and positioning the intake and power cylinders so that they oscillate as the respective pistons and rods move.

The present invention is for a two stroke internal combustion engine having a crank case supporting a crank shaft/fly wheel assembly. The engine has an intake piston and rod assembly having an intake piston portion and an intake rod portion. The intake rod portion thereof, is supported on an intake crank throw of the crank shaft and fly wheel assembly to permit turning of the crank throw within the lower portion of the intake rod portion. An oscillating intake cylinder assembly has an intake cylinder which supports the intake piston and the intake cylinder assembly has an outer face having an intake side trunnion and a power side trunnion about which the oscillating intake cylinder assembly oscillates. Crank case support plates have an intake piston trunnion support face and the piston trunnion support face holds the curved outer face of the intake cylinder trunnion assembly. Means are provided for opening and closing of a passageway for air to pass into the oscillating intake cylinder assembly. Means are also provided for opening and closing a passageway between the intake cylinder and the power cylinder which means are located within the power side trunnion. A power piston and rod assembly have a power piston and a power rod portion. The power rod portion is supported on a power crank throw of the crank shaft fly wheel assembly to permit turning of the crank throw within said power rod portion, said intake crank throw and said power crank throw being 180° out of phase. An oscillating power cylinder assembly has a power cylinder which supports said power piston. The power cylinder assembly has an outer face and has an intake side trunnion and an exhaust side trunnion about which the oscillating power cylinder assembly oscillates. Two power piston trunnion support faces are formed in the crank case support plates and the power piston trunnion support faces hold the intake and exhaust trunnion of the power cylinder assembly. Means are provided for introducing fuel into the air to form an air/fuel mixture. Means are provided for closing the cylinder of said oscillating power cylinder assembly as the piston rises above its bottom stroke in its cylinder to permit the compression and detonation of the air/fuel mixture to impart downward movement to the power piston. Means are also provided for exhausting the resulting burned air/fuel mixture out of the oscillating power cylinder assembly and means are likewise provided for igniting the resulting compressed air/fuel mixture in the power cylinder. The air may be passed into the intake cylinder either through the center of the trunnion or at the top of a curved intake piston support face of the crank case support plates. Preferably the means of exhausting the burned air/fuel mixture is in the trunnion on the exhaust side of the power cylinder. Preferably the fuel is injected into the air passageway in the center of the trunnion assembly between the intake cylinder and the power cylinder. Preferably the compressed air fuel mixture is ignited by a spark plug which is energized by contact with a fixed contact point supported on the crank case support plate. Also fuel may be injected by an injector.

DESCRIPTION OF THE PREFERRED EMBODIMENTS

Figure 1:
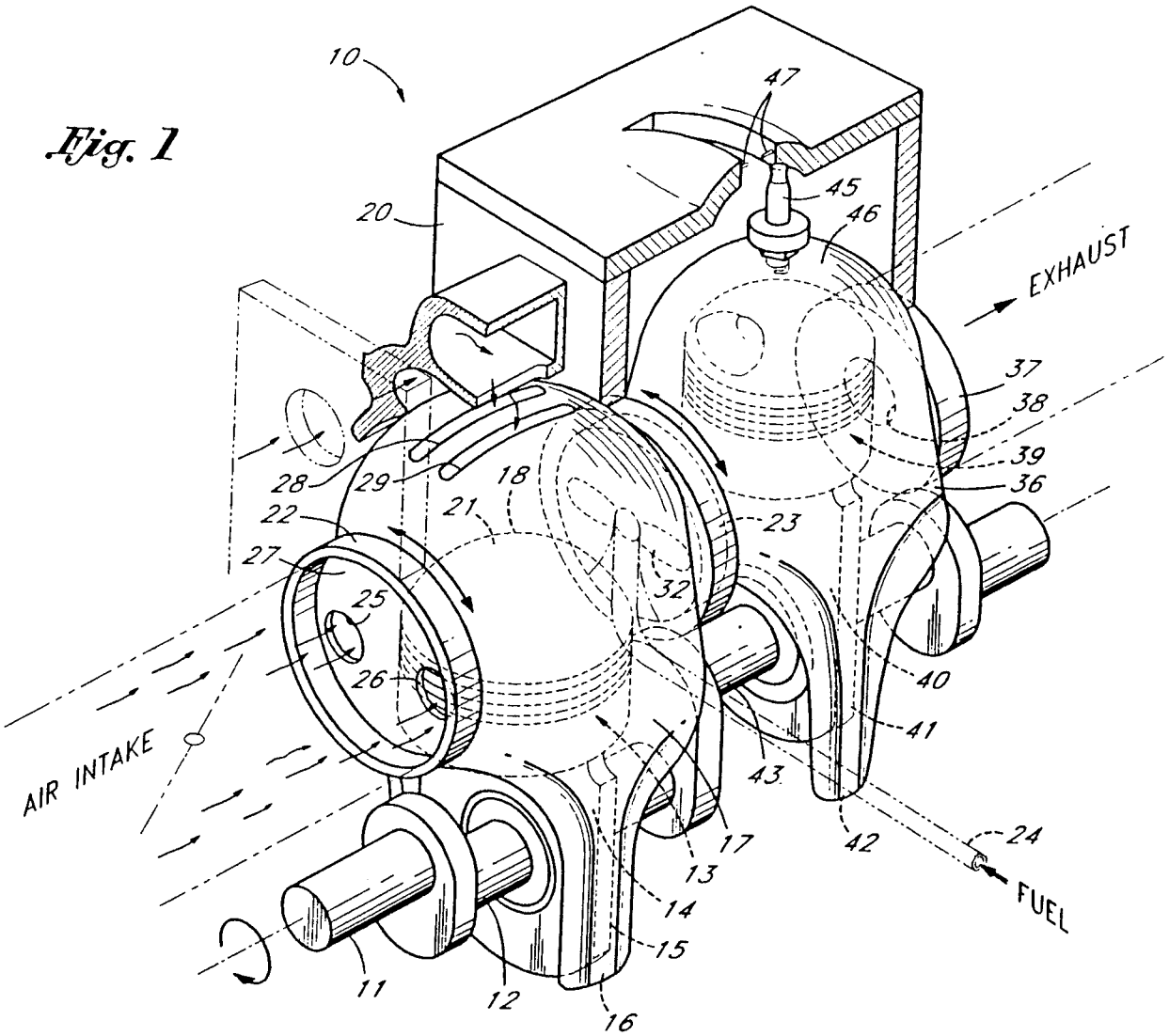
FIG. 1 is a diagrammatic perspective view partially cut away of the two stroke internal combustion engine of the present invention.
Figure 2:
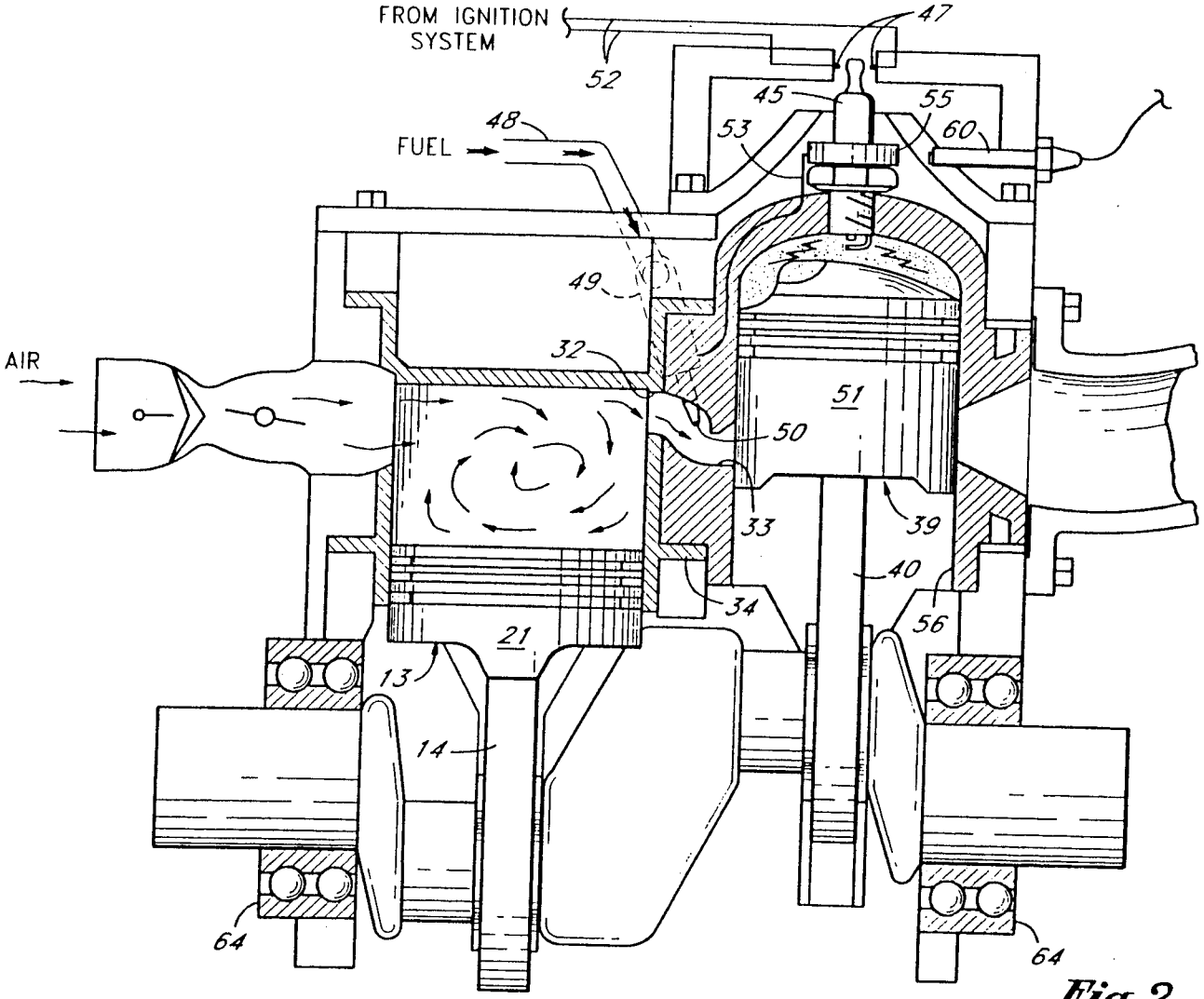
FIG. 2 is a cross-sectional side view of the engine of FIG. 1 with the fuel being introduced through the head of the engine.
Figure 3:
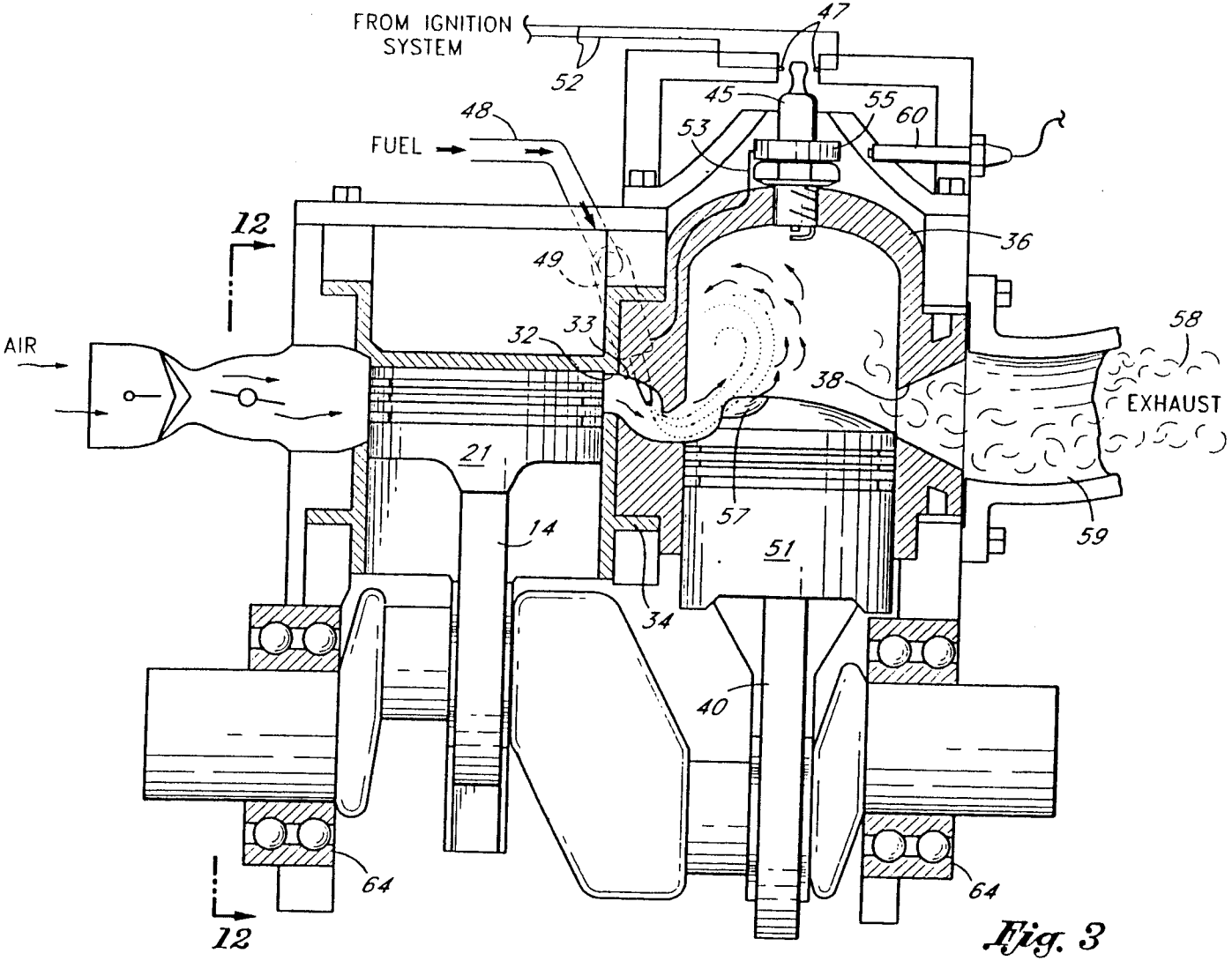
FIG. 3 is a cross-sectional side view of the engine of FIG. 2 with the intake piston in a fully raised position and the power piston in a fully lowered position.

The operation of the two stroke engine of the present invention can most easily be understood by a comparison of FIGS. 1, 2, and 3. Briefly, the assembly has an intake piston and cylinder assembly which feeds air through a trunnion to the power piston and cylinder assembly. Both the intake cylinder assembly and the power cylinder assembly oscillate so that the intake piston and the power piston may have a fixed rod thereby eliminating any inefficiency caused by the misalignment of the rod and the piston which is present in most present day engines.

More specifically, the two stroke engine is indicated generally by reference character 10 in FIG. 1 and a crank shaft 11 has an intake crank throw 12 to which an intake piston and rod assembly 13 is connected. The rod portion 14 has a pair of rails 15 which fit in a pair of grooves 16 in the oscillating intake cylinder assembly 17. Intake cylinder assembly has a curved outer face 18 which closely fits a curved intake piston support face 19 in the support plate 20 of engine 10. Piston 21 is integrally formed with rod portion 14 so that the rod is always at a right angle with respect to the face of piston 21. The oscillating intake cylinder assembly 17 is supported on a pair of trunnions and the intake side trunnion is indicated by reference character 22. The power side trunnion of intake cylinder assembly is indicated by reference character 23. Power side trunnion 23 has an opening in the lower side thereof to permit the passage of fuel line 24 indicated by phantom lines in FIG. 1.

Two different methods of introducing air into the intake cylinder are shown in FIG. 1 and typically only one of these methods would be used in an engine. A pair of ports 25 and 26 are formed in the wall 27 within an intake side trunnion 22. These ports open and close as shown best in FIGS. 12, 13, 14 and 15.

Figure 4:
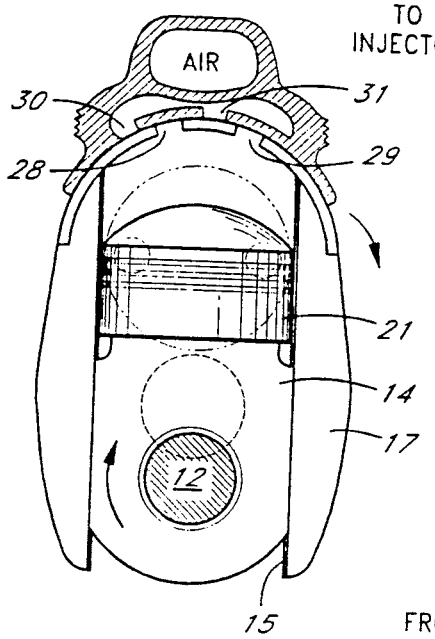
FIG. 4 is a cross-sectional side view of the intake piston assembly of the engine of FIG. 1.
Figure 5:
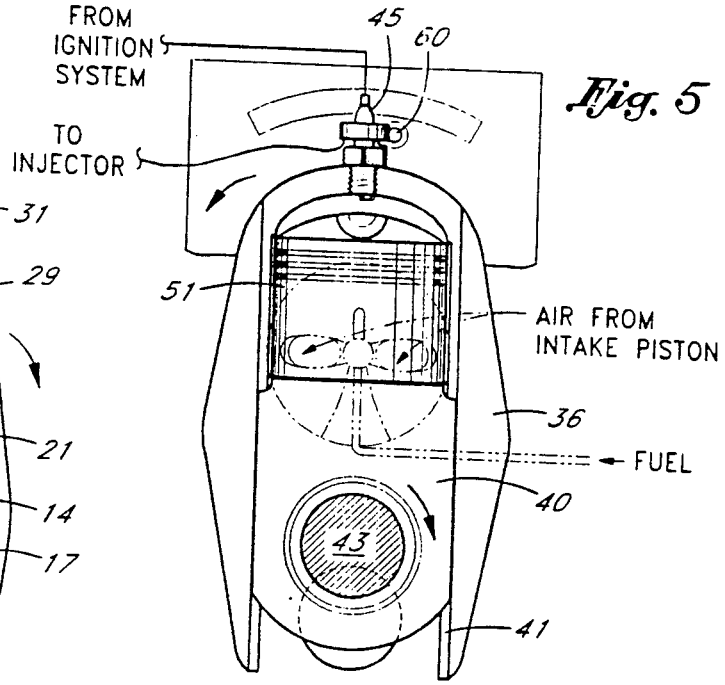
FIG. 5 is a cross-sectional side view of the power piston assembly of the engine of FIG. 1.
Figure 6:
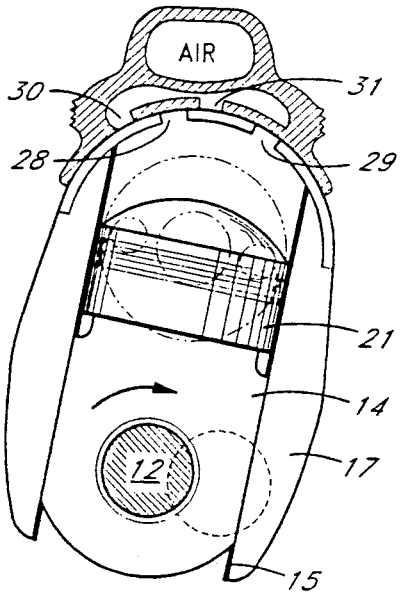
FIG. 6 is a cross-sectional side view of the intake piston assembly of the engine of FIG. 1.
Figure 7:
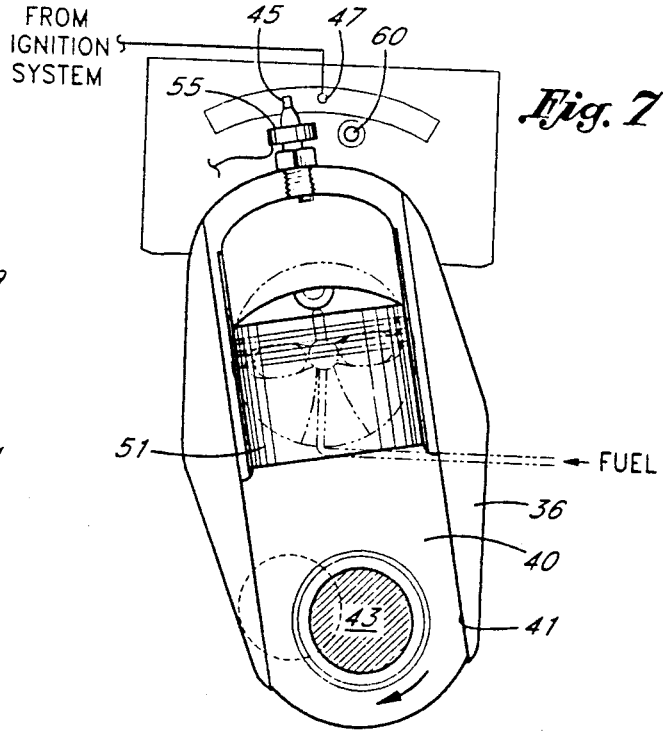
FIG. 7 is a cross-sectional side view of the power piston assembly of the engine of FIG. 1.
Figure 8:
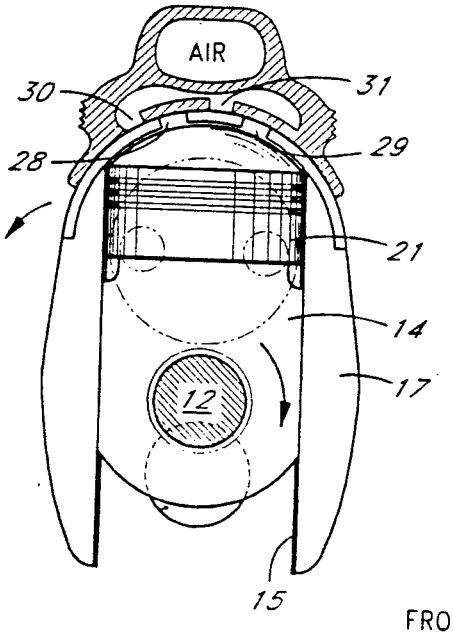
FIG. 8 is a cross-sectional side view of the intake piston assembly of the engine of FIG. 1.
Figure 9:
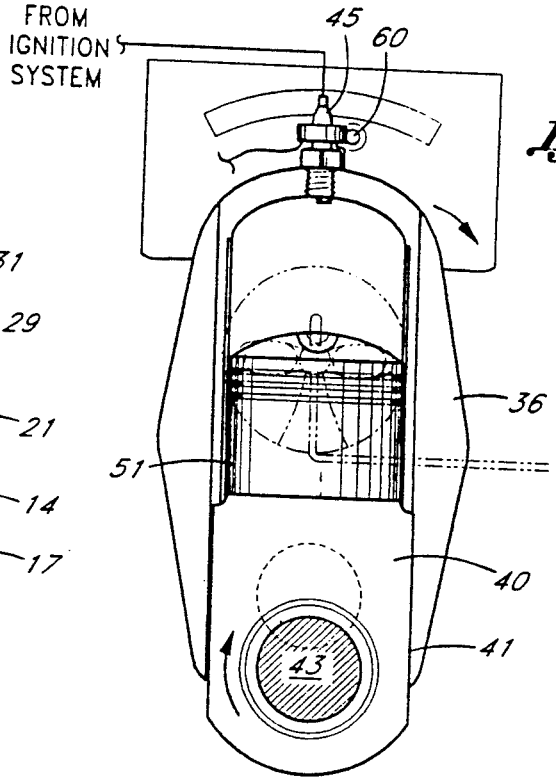
FIG. 9 is a cross-sectional side view of the power piston assembly of FIG. 1.
Figure 10:
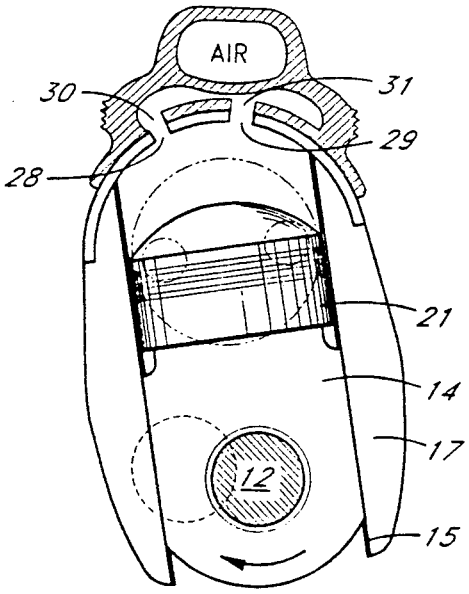
FIG. 10 is a cross-sectional side view of the intake piston assembly of FIG. 1.
Figure 11:
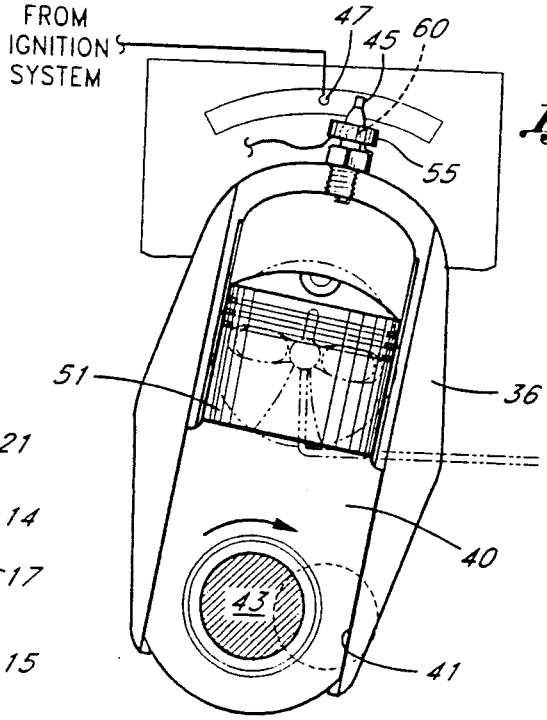
FIG. 11 is a cross-sectional side view of the power piston assembly of FIG. 1.

An alternate method of opening and closing an air passage is also indicated in FIG. 1 where slots 28 and 29 mate with slots 30 and 31 to open and close the ports. This method is shown best in FIGS. 4, 6, 8, and 10. In either method, the air is permitted to enter as the intake piston moves downwardly as shown in FIG. 10. As the intake crank throw 12 continues to turn, as shown in FIG. 4, the air passages 30 and 31 are closed and the air is compressed as the piston continues to rise as shown in FIGS. 6 until the piston reaches its uppermost position shown in FIG. 8. From a side view and showing air entering through ports 25 and 26, the intake piston is shown in a lowermost position in FIG. 2 and an uppermost position in FIG. 3.

Intake cylinder assembly 17 has an elongated opening 32 which connects with a passageway 33 within trunnion 34 which is on the intake side of oscillating power cylinder assembly 36. Oscillating power cylinder assembly also has an exhaust side trunnion 37 through which an exhaust port 38 passes. A power pistion and rod assembly 39 is also an integral unit having a rod portion 40 with a pair of rails 41 which ride up and down in a pair of grooves 42. The power crank throw 43 is positioned on crank shaft 11, 180° out of phase with intake throw 12.

A spark plug 45 is secured in the curved outer face 46 of power cylinder 36. The spark plug is energized by passing between a pair of contacts 47 as described more fully below.

The fuel may be alternatively fed through a grid atop the oscillating intake cylinder as indicated in FIG. 2 where fuel line 48 passes into an injector 49 which has a nozzle 50 in passageway 33. The power piston 51 is shown in its uppermost position in FIG. 2 and spark plug 45 is ignited by passing adjacent contact points 47 which are connected to wires 52 from the ignition system. It is also contemplated that injector 49 may be energized by having a wire 53 affixed to a contact ring 55 which wire is energized when contact ring 55 passes adjacent energy emitting assembly 60. It also should be noted from FIG. 2 that the rod portion 14 of intake piston and rod assembly 13 is shorter than the rod portion 40 of power piston and rod assembly 39. This permits the positioning of piston 51 above piston 21, thereby permitting opening 32 to be only about half way along the side of the cylinder wall 56.

Turning now to FIG. 3, the intake piston 21 is shown in its uppermost position and the power piston 51 is shown in its lowermost position. In this position, fuel is introduced through injector 49 and abuts a receiving cup 57 in the upper surface of power piston 51 to direct the fuel upwardly into the open cylinder. Meantime, the exhaust gases 58 are urged out of exhaust port 59 having passed through exhaust port 38 in the oscillating power cylinder assembly 36. Then as piston 51 moves upwardly and piston 21 moves downwardly, the fuel air mixture is compressed as shown best in FIG. 2 at which point spark plug 45 is again energized.

Turning now to FIGS. 4 through 11, it can be readily seen that both intake piston 21 and exhaust piston 51 are always aligned with intake rod 14 and power rod 40. It can also be seen that the rails 15 and 41 have a long contact surface so that excessive pressure is not exerted against cylinder assemblies 17 and 36. One of the timing methods useful with the engine of the present invention is also indicated in FIGS. 5, 7, 9 and 11 where ignition occurs in FIG. 5 when spark plug 45 is adjacent the contact points 47. It should also be noted that at FIG. 9, the spark plug 45 is also aligned with points 47, but the ignition system is not energized during this stroke.

Furthermore, the position of the injector assembly is shown in FIG. 3 and is indicated in FIGS. 5, 7, 9 and 11. It can be seen in FIG. 11 that the contact ring 55 is adjacent energy emitting assembly 60. As the oscillating cylinder apexes fully aligning energy emitting assembly 60 with contact ring 55, injector 49 is opened, which signals the energizing of the injector 49.

Figure 12:
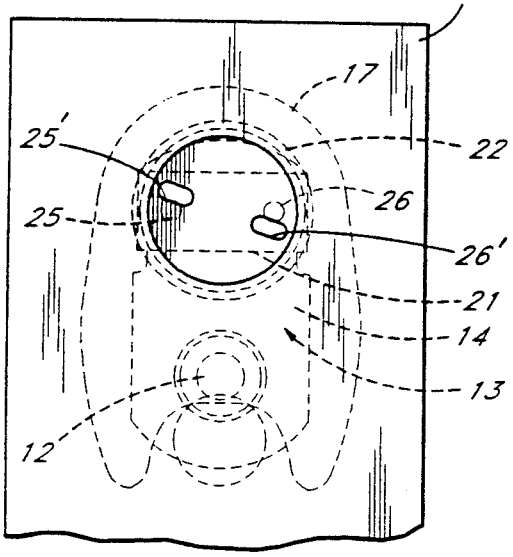
FIG. 12 is a cross-sectional side view of the trunnion assembly of the engine of FIG. 1.
Figure 13:
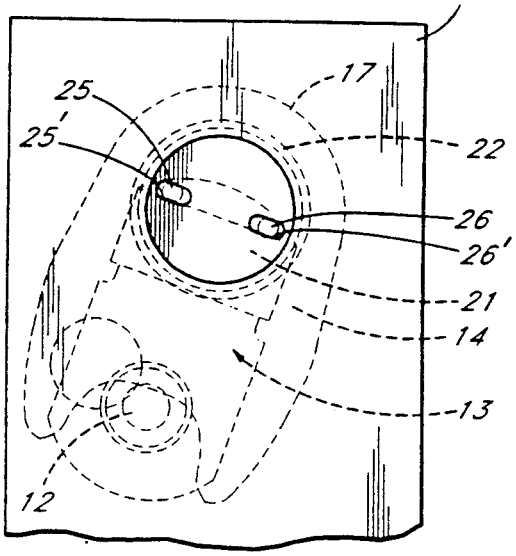
FIG. 13 is a cross-sectional side view of the trunnion assembly of FIG. 1.
Figure 14:
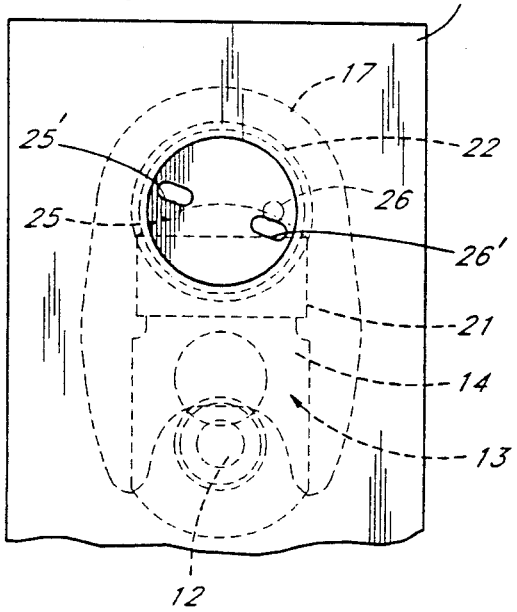
FIG. 14 is a cross-sectional side view of the trunnion assembly of the engine of FIG. 1.
Figure 15:
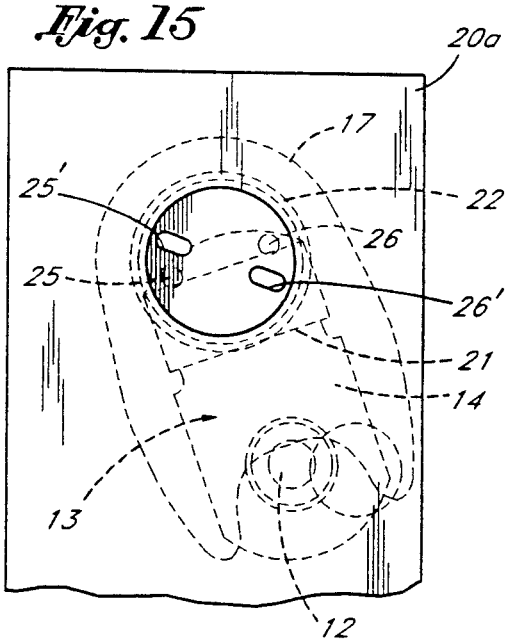
FIG. 15 is a cross-sectional side view of the trunnion assembly of the engine of FIG. 1.

Turning now to the air flow into the intake cylinder and the movement between the intake cylinder assembly and the trunnion support plate, the relative movements at this interface are shown in FIGS. 12, 13, 14, and 15. Openings 25' and 26' are formed in plate 20*a*. As the trunnion 22 oscillates the openings 25 and 26 move in and out of alignment with opening 25' and 26' as shown in FIGS. 12 though 15.

Figure 17:
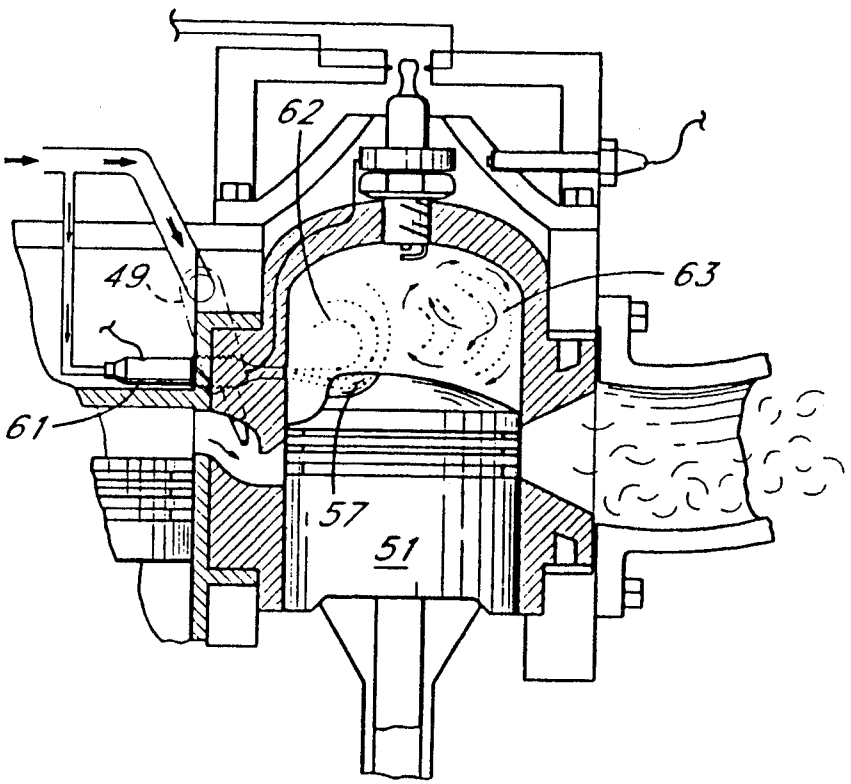
FIG. 17 is a cross-sectional side view of the power cylinder and piston assembly of FIG. 16.
Figure 16:
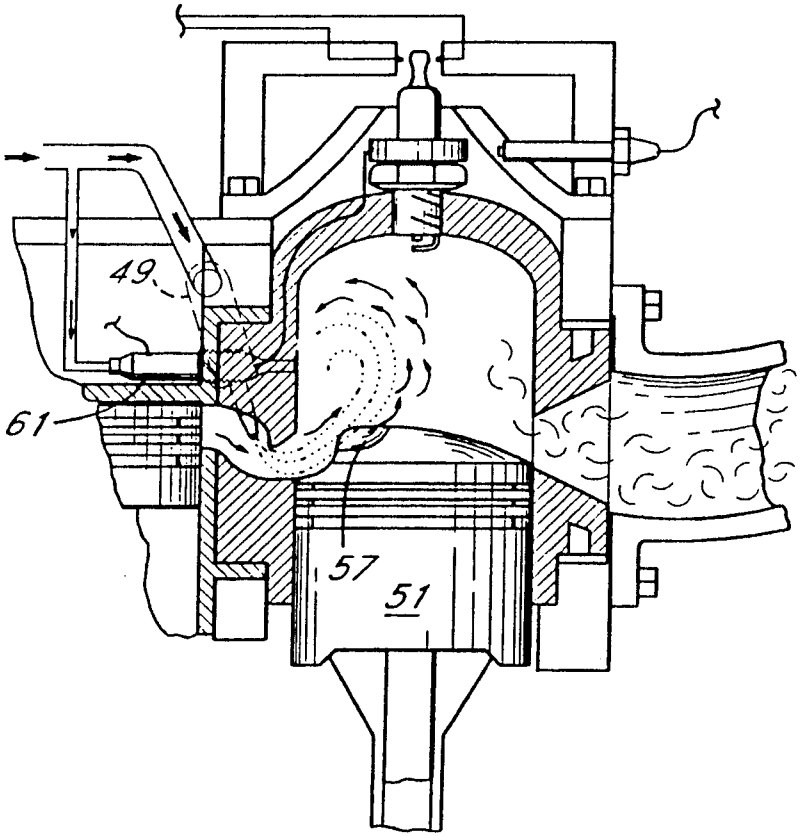
FIG. 16 is a cross-sectional side view of an alternate embodiment of the power piston of the engine of FIG. 1.

An alternate method of injecting the fuel in a most efficient manner is indicated in FIGS. 16 and 17 of the drawings. A pair of injectors 49 and 61 are shown. Injector 49 is activated as a indicated above and second injector 61 is energized at a slightly later time and contacts a second impression 62 in power cylinder 51. This provides a complete and uniform filling of the volume 63 being compressed as shown in FIG. 17 and indicated by reference character 63.

Because of the combined effects of the oscillating cylinders and adjacent intake and power cylinders, a two stroke engine with exceptional efficiency results. The engine can be made with an absolute minimum of weight and completely eliminates the valve train, wrist pin and inefficient alignment of the piston and piston rod. It is envisioned that a four-power piston engine could be made which would be convertible from four power cylinders to two power cylinders, once the engine had reached operating speeds. The engine would be approximately half the weight of conventional four cycle engines and may have a wet sump. It is envisioned that roller bearings 64 as shown in FIGS. 2 and 3 could be used.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A two stroke internal combustion engine having an engine block supporting a crankshaft/flywheel assembly comprising:

an intake piston and rod assembly having an intake piston portion and an intake rod portion, said intake rod portion thereof being supported on an intake crank throw of the crankshaft/flywheel assembly to permit turning of the crank throw within said intake rod portion;

an oscillating intake cylinder assembly having an intake cylinder which supports said intake piston, said intake cylinder assembly having an outer face and having an intake side trunnion and a power side trunnion about which the oscillating intake cylinder assembly oscillates;

crank case support plates having an intake piston trunnion support face, said intake piston trunnion support face holding the intake and exhaust side trunnions of said intake cylinder assembly;

means for opening and closing a passageway for air into said oscillating intake cylinder assembly;

means for opening and closing a passageway between said intake cylinder and a power cylinder, said means for opening and closing a passageway being located within said power side trunnion;

a power piston and rod assembly having a power piston portion and a power rod portion, said power rod portion thereof being supported on a power crank throw of the crankshaft/flywheel assembly to permit turning of the crank throw within said power rod portion, said intake crank throw and said power crank throw being 180° out of phase;

an oscillating power cylinder assembly having a power cylinder which supports said power piston, said power cylinder assembly having an outer face and having an intake side trunnion and an exhaust side trunnion about which the oscillating power cylinder assembly oscillates;

a pair of power piston trunnion support faces formed in said crank case support plates, said pair of power piston trunnion support faces holding the intake and exhaust side trunnions of said power cylinder assembly;

means for introducing fuel into the air to form an air/fuel mixture;

means for closing said cylinder of said oscillating power cylinder assembly above said power piston to permit the compression and detonation of said air/fuel mixture to impart downward movement to said power piston;

means for exhausting the resulting burned air/fuel mixture out of said oscillating power cylinder assembly; and means for igniting the resulting compressed air/fuel mixture in said power cylinder.

2. The two stroke internal combustion engine of claim 1 wherein said means for opening and closing a passageway for air into said oscillating intake cylinder assembly comprises at least one trunnion-opening in a trunnion face formed within said intake side trunnion and at least one mating cylinder-opening through the intake cylinder assembly, said trunnion opening and said cylinder opening moving in and out of overlapping as the cylinder oscillates.

3. The two stroke internal combustion engine of claim 2 wherein there are two trunnion openings.

4. The two stroke internal combustion engine of claim 1 wherein said means for opening and closing a passageway for air between said intake cylinder and said power cylinder comprises at least one intake cylinder opening in an intake cylinder power side trunnion wall and a mating power cylinder opening in a trunnion face of said power intake side trunnion, said intake cylinder opening and said power cylinder opening moving in and out of overlapping as the intake cylinder and the power cylinder oscillate.

5. The two stroke internal combustion engine of claim 4 wherein there are two openings in said intake cylinder power side trunnion wall and two mating power cylinder openings in said trunnion face of said power intake side trunnion.

6. The two stroke internal combustion engine of claim 1 wherein said means for exhausting burned air/fuel mixture from said power cylinder comprises at least one opening in a trunnion wall formed within said exhaust side trunnion.

7. The two stroke internal combustion engine of claim 1 wherein said means for introducing fuel into said air comprises injecting fuel through a fuel line positioned within an opening in said intake cylinder opening in a trunnion face of said power intake side trunnion.

8. The two stroke internal combustion engine of claim 7 wherein said fuel line is held by the crank case support head.

9. The two stroke internal combustion engine of claim 8 wherein there is a first and a second injector connected to said fuel line, the first of said injectors being positioned so that it injects fuel in said opening in the trunnion face of said power side intake trunnion and the second injector is positioned so that it injects fuel through a wall of the oscillating power cylinder above the opening in the trunnion face of said power side intake trunnion.

10. The two stroke internal combustion engine of claim 1 wherein said means for igniting the resulting compressed air/fuel mixture comprises a spark plug secured to the oscillating power cylinder at the top thereof and wherein the spark plug is energized as it moves into contact with a contact point affixed to said crank case support plate.

11. A two stroke internal combustion engine having an engine block supporting a crankshaft/flywheel assembly comprising:

an intake piston and rod assembly having an intake piston portion and an intake rod portion, said intake rod portion thereof being supported on an intake crank throw of the crankshaft/flywheel assembly to permit turning of the crank throw within said intake rod portion and said intake rod portion having an intake rod length;

an oscillating intake cylinder assembly having an intake cylinder which supports said intake piston, said intake cylinder assembly having a curved outer face and having an intake side trunnion and a power side trunnion which trunnions have a trunnion axis of oscillation about which the oscillating intake cylinder assembly oscillates, said oscillating intake cylinder assembly having an intake cylinder upper surface;

a crank case supporting plate having a curved intake piston support face, said intake piston support face holding the curved outer face of said intake cylinder assembly;

means for opening and closing a passageway for air into said oscillating intake cylinder assembly;

means for opening and closing a passageway between said intake cylinder and a power cylinder, said means for opening and closing a passageway being located within said power side trunnion;

a power piston and rod assembly having a power piston portion and a power rod portion, said power rod portion thereof being supported on a power crank throw of the crankshaft/flywheel assembly to permit turning of the crank throw within said power rod portion, said intake crank throw and said power crank throw being 180° out of phase, said power rod portion being longer than said intake rod portion;

an oscillating power cylinder assembly having a power cylinder which supports said power piston, said power cylinder assembly having a curved outer face and having an intake side trunnion and an exhaust side trunnion which trunnions oscillate about said trunnion axis of oscillation, and said oscillating power cylinder has a power cylinder upper surface which is farther removed from said trunnion axis of oscillation than is the intake cylinder upper surface;

a curved power piston support face formed in said crank case support plate, said curved power piston support face holding the curved outer face of said power cylinder assembly;

means for introducing fuel into the air to form an air/fuel mixture, said means for introducing fuel comprises a fuel injector held by said crank case support plate and having an injector outlet within a power cylinder trunnion wall formed within said intake side trunnion of said power cylinder;

means for closing said cylinder of said oscillating power cylinder assembly above said power piston to permit the compression and detonation of said air/fuel mixture to impart downward movement to said power piston;

means for exhausting the resulting burned air/fuel mixture out of said oscillating power cylinder assembly; and means for igniting the resulting compressed air/fuel mixture in said power cylinder.

12. The two stroke internal combustion engine of claim 11 wherein said means for igniting the resulting compressed air/fuel mixture comprises a spark plug secured to the oscillating power cylinder at the top thereof and wherein the spark plug is energized as it moves into contact with a contact point affixed to said crank case support plate.

13. The two stroke internal combustion engine of claim 12 wherein said fuel injector is operated by a conductive member affixed to said spark plug.

* * * * *